US006155387A

United States Patent [19]

Sauter

[11] Patent Number: 6,155,387

[45] Date of Patent: Dec. 5, 2000

[54] TRUCK MOUNTED BRAKE BEAM AND METHOD OF MANUFACTURING

[75] Inventor: Jeffrey F. Sauter, Lowville, N.Y.

[73] Assignee: New York Air Brake Corporation, Watertown, N.Y.

[21] Appl. No.: 09/046,847

[22] Filed: Mar. 13, 1998

Related U.S. Application Data

[63] Continuation-in-part of application No. 08/874,228, Jun. 13, 1997, Pat. No. 5,947,236.

[51] Int. Cl.[7] ..... B61H 13/00; B61H 13/36

[52] U.S. Cl. ..... 188/226.1; 188/219.1; 188/228.1; 188/228.6; 188/233.3; 188/233.7

[58] Field of Search ..... 188/219.1, 222.1, 188/223.1, 223.6, 224.1, 225.6, 226.1, 228.1, 228.6, 229.1, 229.6, 231, 232, 233.3, 233.7, 207

[56] References Cited

U.S. PATENT DOCUMENTS

| | | |
|---|---|---|
| 568,044 | 9/1896 | Robischung . |
| 575,420 | 1/1897 | Farley . |
| 794,404 | 7/1905 | Green . |
| 796,714 | 8/1905 | Frost . |
| 979,968 | 12/1910 | Kofske . |
| 1,144,403 | 6/1915 | Williams, Jr. . |
| 1,203,469 | 10/1916 | Busse . |
| 2,116,594 | 5/1938 | Busch . |
| 2,182,210 | 12/1939 | Osner et al. . |
| 2,329,247 | 9/1943 | Busse et al. . |
| 2,480,857 | 9/1949 | Hess . |
| 2,491,086 | 12/1949 | Busch . |
| 2,517,199 | 8/1950 | Gothberg . |
| 2,885,036 | 5/1959 | Walker . |
| 3,499,507 | 3/1970 | Scott et al. . |
| 3,907,078 | 9/1975 | Means . |
| 4,793,446 | 12/1988 | Hart et al. . |
| 5,400,874 | 3/1995 | Gayfer et al. . |
| 5,947,236 | 9/1999 | Sauter ..... 188/233.3 |

*Primary Examiner*—Douglas C. Butler
*Attorney, Agent, or Firm*—Barnes & Thornburg

[57] ABSTRACT

A truck mounted rail brake including at least a primary beam having a center section and a pair of end sections with guide feet. The center portion may include two opposed channel elements, each having a horizontal base and two vertical walls, jointed by the fasteners or first weldments. The vertical walls of the opposed channeled elements may extend either from the base towards each other or away from each other. The first weldments are hollow and the bases include openings to the hollow of the first weldments. The cross-section of the end portions of at least one of the channeled elements are smaller than the cross-section of a center portion of the at least one channeled element.

12 Claims, 7 Drawing Sheets

TRUCK MOUNTED BRAKE BEAM AND METHOD OF MANUFACTURING

CROSS-REFERENCE

This is a continuation-in-part of U.S. application Ser. No. 08/874,228, filed Jun. 13, 1997, titled Truck Mounted Brake for Standard and Premium Ride Trucks, now U.S. Pat. No. 5,947,236.

BACKGROUND AND SUMMARY OF THE INVENTION

The present invention relates generally to brake apparatus for rail cars, and more specially to truck mounted brake apparatus.

Truck mounted brakes throughout the railroad industry include either a double actuator system as illustrated in U.S. Pat. No. 3,499,507 or a single actuator system as illustrated in U.S. Pat. Nos. 5,400,874 and 5,495,921. In all three of these systems, the actuator rods extend through holes in the bolster of the truck. The primary and secondary beams are unitary cast iron beams. The beams are U-shaped having a vertical base and two horizontal walls extending therefrom. The actuator or actuators are mounted to the vertical base and the actuator rods are mounted and extend through openings also in the vertical base.

Another example of a truck mounted brake having a single actuator is illustrated in U.S. Pat. Nos. 4,766,980 and 4,653,812. By moving the actuator rods outside of the center section, they pass under the bolster of the truck and no holes through the bolsters are required. The brake beams are shown as having a rolled steel center channel section with end sections having cast brake shoe heads and projecting guide feet bolted to the center section. As with the previous unitary beams, the channeled portion is generally U-shaped having a vertical base wall with two opposed horizontal walls extending therefrom.

There is a continuous drive to reduce the cost, size and weight of the truck mounted brake.

The present invention is a truck mounted rail brake including at least a primary beam having a center section and a pair of end sections with guide feet to be received in the slots of the truck. The center portion may include two opposed channel elements, each having a horizontal base and two vertical walls, joined by the fasteners or first weldments. The vertical walls of the opposed channeled elements may extend either from the base towards each other or away from each other. The first weldments are hollow and the bases include openings to the hollow of the first weldments. The cross-section of the end portions of at least one of the channeled elements are smaller than the cross-section of a center portion of the at least one channeled element.

A brake actuator is supported either by the end sections or the center section of the primary beam. The bases include a boss at the connection of the actuator to the center section.

The end sections are joined to the channeled elements by fasteners or weldments. A brake head is integral to each end section which is joined to the center section by fasteners or removably joined to the end section which is integral to the center section. This allows removal of the brake head without removing the brake beam.

A second brake beam may be included also having a center section with a pair of end sections including guide feet. The second beam also includes at least one channel member having a horizontal base and two vertical walls.

Force transmitters, or rods, which extend from the actuator, are connected to the secondary beam at the center or end sections. The force transmitters may extend around the truck or through the truck.

A method of making a brake beam includes obtaining a first and second channeled elements having a base and two vertical walls extending from the base; separating an end portion of one of the vertical walls from the base of the first channeled element; removing a section of the end portion of the base adjacent the separated vertical wall; attaching the separated end portion of the vertical wall to the remaining end portion of the base; and joining the first and second channeled elements. Both ends of one of the vertical walls or both ends of both vertical walls of the first channeled element are similarly processed. Also, one or both of the vertical walls of the second channeled element may be similarly processed. The attaching of the vertical wall of the base includes welding. The joining of the channeled elements includes welding a spacer or weldment between opposed bases. An end section, having a guide foot to be received in slots in a truck, is welded to the joined channeled elements. The first channeled element is shorter than the second channeled element. This accommodates the attachment of the end sections. A boss is attached on the base at a location of a connection of the actuator to the channeled elements.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
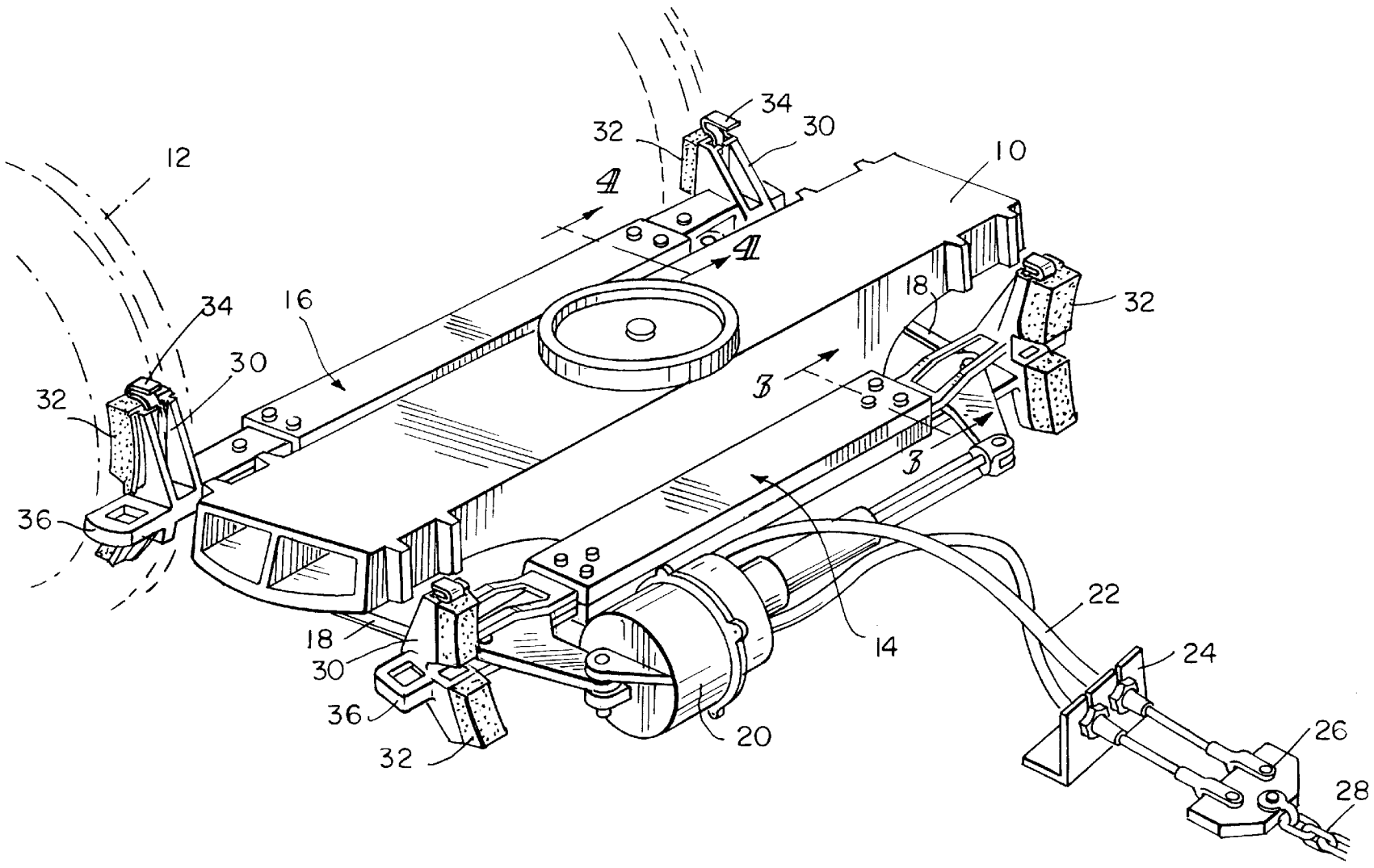
FIG. 1 is a perspective view of a truck mounted brake mounted to the truck incorporating the principles of the present invention.

A truck mounted brake is shown in FIG. 1 with respect to bolster 10 of the truck and a wheel 12. The illustration is for a double axle truck and therefore will be described with respect to two brake beams. It should be noted that the system may also be used with a single axle and therefore a single brake beam.

Figure 2:
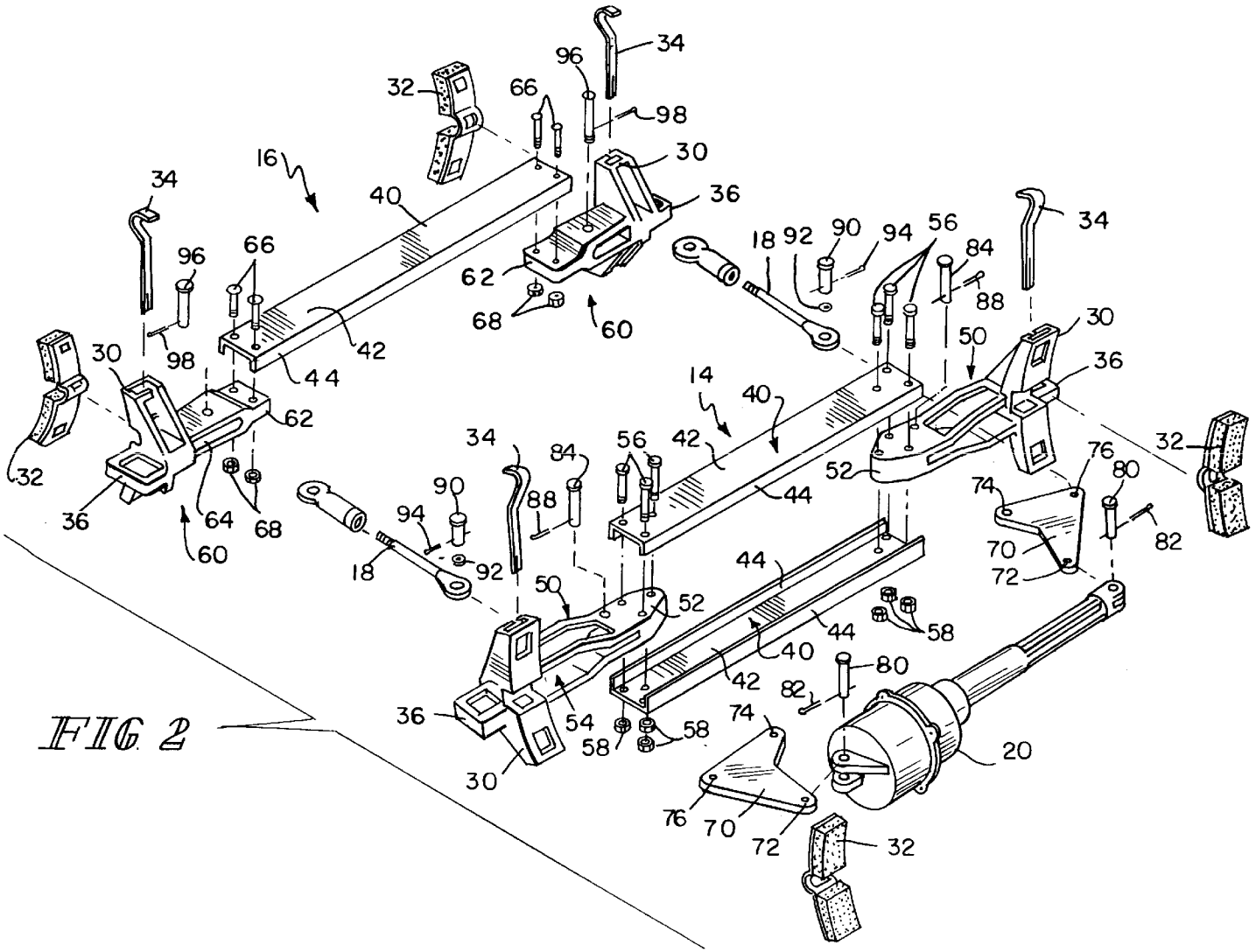
FIG. 2 is an exploded view of the truck mounted brake of FIG. 1 incorporating the principles of the present invention.

The truck mounted brake illustrated in FIGS. 1 and 2 include a primary brake beam 14 and a secondary brake beam 16 on opposite sides of the bolster 12 and interconnected by force transmission or push rod assembly 18. An actuator 20 is supported by the primary beam 14 and is connected to the secondary beam 16 by the push rods 18. A hand brake cable 22 is connected to the actuator 20 and to cable reaction bracket 24, equalization plate 26 and chain 28.

At each end of the primary beam 14 and the secondary beam 16, is a brake head 30 having brake shoes 32 secured thereto by removable latch 34. Also, extending from the ends of each of the brake beams are guide feet 36 which are received in slots in the side walls of the truck. Each of the brake heads 30 and brake shoes 32 are adjacent to respective wheel 12, only one of which is illustrated.

The system so far described is well known in the industry and is illustrated for example, in U.S. Pat. Nos. 4,766,980 and 4,653,812. The operation of the actuator 20, with or without slack adjusters, and the push rod assemblies 18 to operate the pair of brake beams 14 and 16 is well known and will not be described here in detail.

Figure 3:
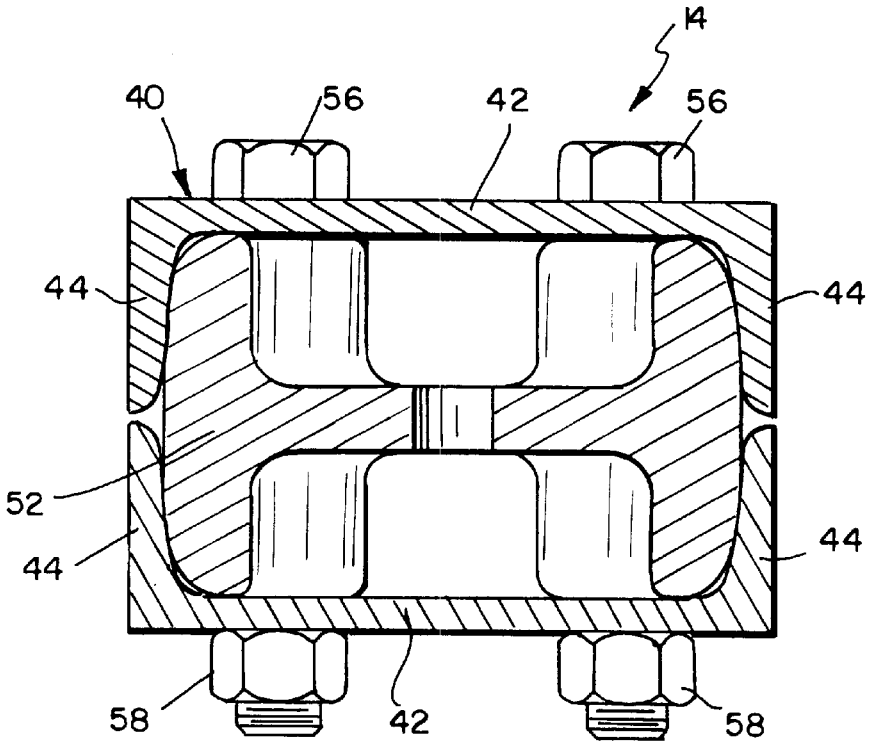
FIG. 3 is a cross section taken along lines III—III of FIG. 1 of the primary beam.
Figure 4:
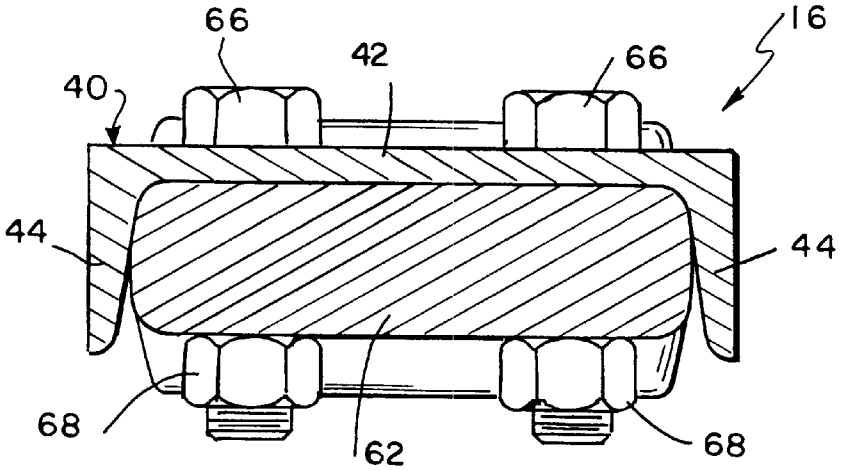
FIG. 4 is a cross section taken along lines IV—IV of FIG. 1 of the secondary brake beam.

A first embodiment of the improved brake beam system of the present invention is illustrated in detail in FIGS. 2–4. The primary beam 14 and the secondary beam 16 each include a center section having one or more channeled elements 40 each including a horizontal base 42 and pair of vertical side walls 44. While the secondary beam 16 includes only one channel member 40, the primary beam 14 includes a pair of opposed channel members 40. In both beams, the base 42 is horizontal and the side walls 44 are vertical. This increases the stiffness of the center of the beams to braking forces transverse to the side walls 44 and within the plane of the base 42. This is to be distinguished from the U-shaped beams of the prior art wherein the corresponding base wall 42 is vertical and the corresponding side walls 44 are horizontal.

The specific orientation and design of the present center sections 40 allows them to be standard U or C channeled stock of substantially reduced weight and cost compared to that of the prior art brake beams. The channeled stock has a large radius of curvature or thickened intersection of the vertical walls 44 to the base 42 which increases the rigidity. Also, box channel or rectangular cross-section stock may be used. Initial results show almost a 50% reduction of weight compared to beams presently in use. Another advantage of using stock channels for the center section of the beam is easy of modification for different gauge tracks. No redesign or special forging is needed.

The primary brake beam 14 includes a pair of end section 50 having a tongue portion 52 slidably received within the channel of the center section 40. An opening 54 is provided in the end section 50 for the force transmission mechanism. Fasteners 56 extend through aligned apertures in the base wall 42 of the center section and the tongue 52 of the end section and into nuts 58 to secure the end sections in their extended position relative to the center section 40. Fasteners 56 secure or lock the end sections in their extended positon and secure the pair of center setions 40 to each other.

The secondary beam 16 also includes a pair of end sections 60 having a tongue 62 received within the channel of the center section 40. A pair of fasteners 66 extend through the horizontal wall 42 of the center section 40 and through aligned apertures in the tongue 62 of the end section 60 and into nuts 68 to secure the end sections in their extended position relative to the center section 60.

The actuator 20 is supported by the primary brake beam 16 through bell crank lever 70. Opposite ends of the actuator 20 are secured by pins 80 received through aperture 72 in the bell crank 70. A cotter pin 82 connected through the end of the pin 80. The bell crank 70 is pivotally connected to the end section 50 in opening 54 of the first beam by a pin 84 received in aperture 74. A cotter pin 88 is provided at the end of pin 84 to secure it in place. One end of the push rod assembly 18 is secured to he bell crank 70 by a pin 90 received in aperture 76 of the bell crank 70. A bushing 92 is provided in the end of the bush rod assembly 18 and a cotter pin 94 holds the pin 90 in place. The other end of the push rod 18 is received in opening 64 of the end section 60 of the second beam 16 and is secured therein by pin 96 and cotter pin 98.

A method of removing either of the brake beams 14 and 16 from the truck mounted brake includes disconnecting the push rod assembly 18 from the ends of the beam to be removed by removing one of the pins 90 or 96 or pin 84 for the bell crank 70. Next, the fasteners 56 or 66 are also removed to allow one end section 50 or 60 of the brake beam to be moved from its extended to its contracted position sliding within the center channel section 40. This will remove the foot guide 36 from the slot of the truck. This contracts the overall length of the beam sufficient to allow not only removal of the foot guide 36 from the end which has been contracted, but also foot guide 36 of the other end which is still in its extended position. For example, the difference between the extended and contracted position could be for example, three to five inches. The tongues 52 and 62 of the end portions 15 and 16 are so designed to allow that amount of contraction. It should be noted that only one of the end portions 50 or 60 need be moved from its extended to its contracted position to remove the whole beam.

To remove just one of the ends 50 or 60 to replace either the brake head 30 or the brake shoe 32, the fasteners 56 or 66 of that end are removed and the end section 50 or 60 is contracted from its extended position into the center channel section 40. The brake beam 14 or 16 is then repositioned relative to the truck sufficiently to allow the contacted end section 50 or 60 to be re-extended and removed from the center section 40. This can be accomplished without removing the total beam 14 or 16 from the truck. As in the total beam, the end of the push rod assembly 18 must be disconnected from the end section 50 or 60 which is to be removed.

The method of assembly is the reverse of the method of disassembly wherein one end section 50 or 60 of the brake beam 14 or 16 is secured to the center section in its extended position and the other end section is contracted. Upon insertion of the foot guide 36 of the extended end section into the slot in the truck, the other end is extended to its extended position with its foot guide 36 being received in a slot in the truck and it is secured in its extended position by appropriate fasteners 56 or 66.

Another embodiment of the brake beam incorporating the principles of the present invention is illustrated in FIGS. 5 through 10. Those elements which have the same general structure and function as that as in FIGS. 2–4 have the same numbers. Those having modified or new part elements have odd numbers. The purpose of the embodiment of FIGS. 5–10 as distinguished from that of FIGS. 2–4 is that in FIGS. 5–10, actuator 20 and push rods 18 stay with the beams and are not removed with the brake heads 30. In FIGS. 2–4, the actuator 20 and the connecting rods 18 are moved with the brake heads 30.

The primary beam 14 and the secondary beam 16 each include a center section having two opposed channeled elements 40A,B and 40C,D respectively. Each includes a horizontal base 42 and pair of vertical side walls 44. In both beams, the base 42 is horizontal and the side walls 44 are vertical. The specific orientation and design of the present center sections 40 allows them to be standard U or C channeled stock of substantially reduced weight compared to that of the prior art brake beams. Also, box channel or rectangular cross-section stock may be used.

The channeled elements 40 of the primary and secondary brake beams have their opposed bases 42 adjacent with their vertical walls 44 extending away from each other. In the embodiment of FIGS. 1–4, the vertical walls 40 extend towards each other from their opposed bases 42. A pair of first weldments 51 secure the top channeled elements 40A, 40C to the bottom channeled elements 40B,D. Openings 41 in the base provide access to the hollowed weldments 51 and allows debris and water to run off through the weldments. The top channeled elements 40A,C are shorter in length than the bottom channeled elements 40B,D and are secured to each other at their ends by a second weldment illustrated as a plate 53. The guide feet 36 are secured to the center channeled elements 40 by the weldment 53 and a third weldment 55 connected to the bottom channeled element 40B,D.

Figure 7:
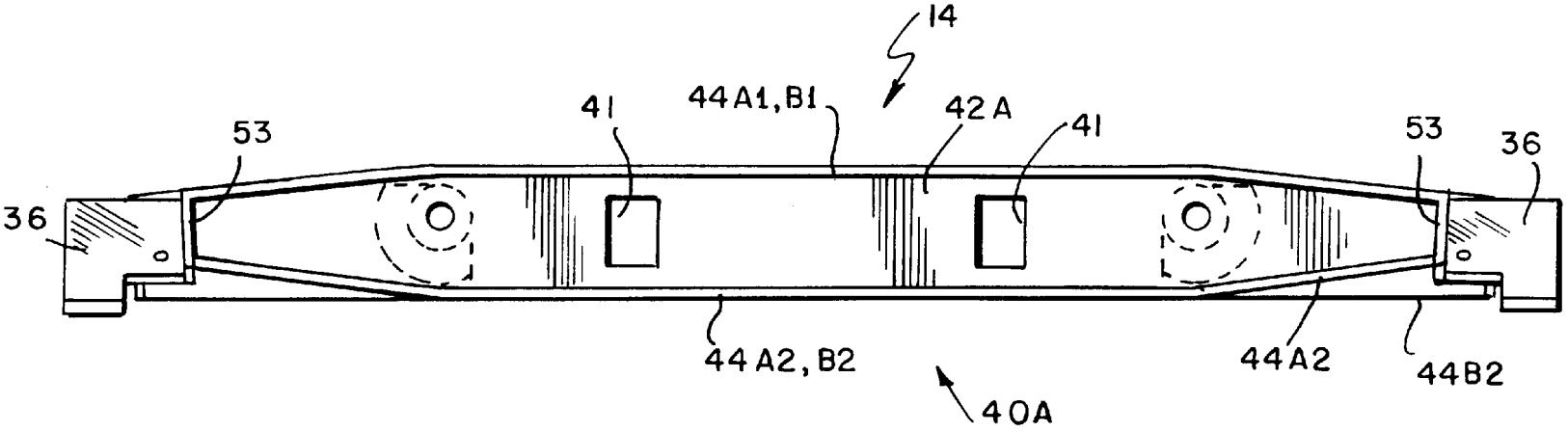
FIG. 7 is a plan view of the primary beam of FIG. 5 without brake heads.
Figure 8:
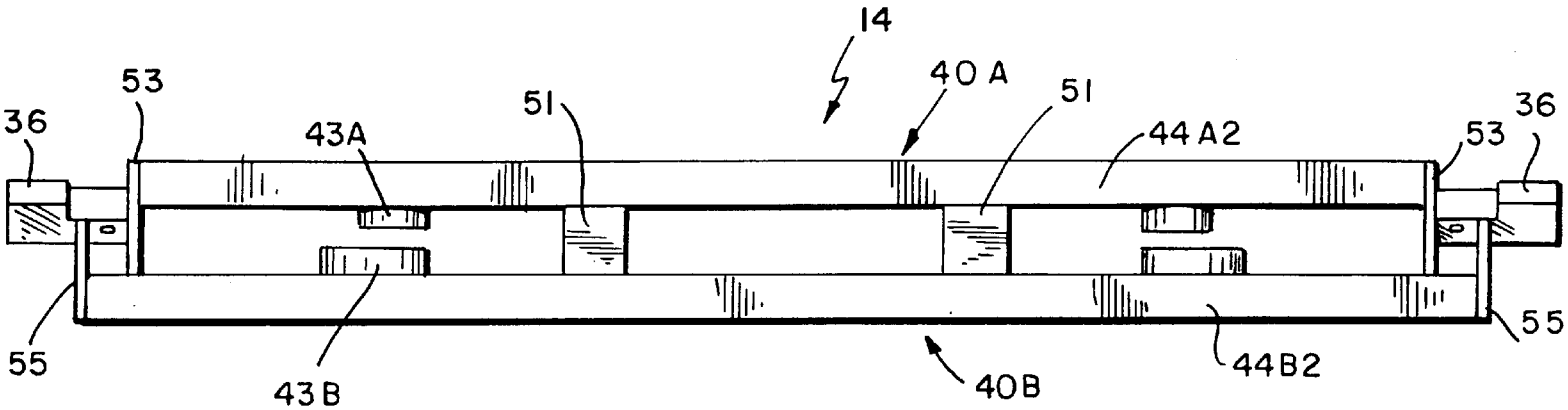
FIG. 8 is a side view of the primary beam of FIG. 7.
Figure 9:
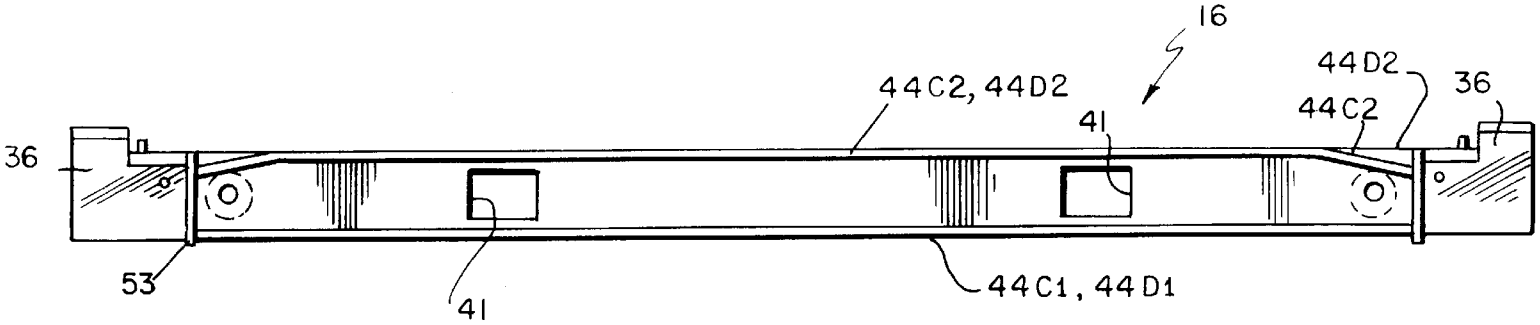
FIG. 9 is a plan view of the secondary beam of FIG. 5 without brake heads.
Figure 10:
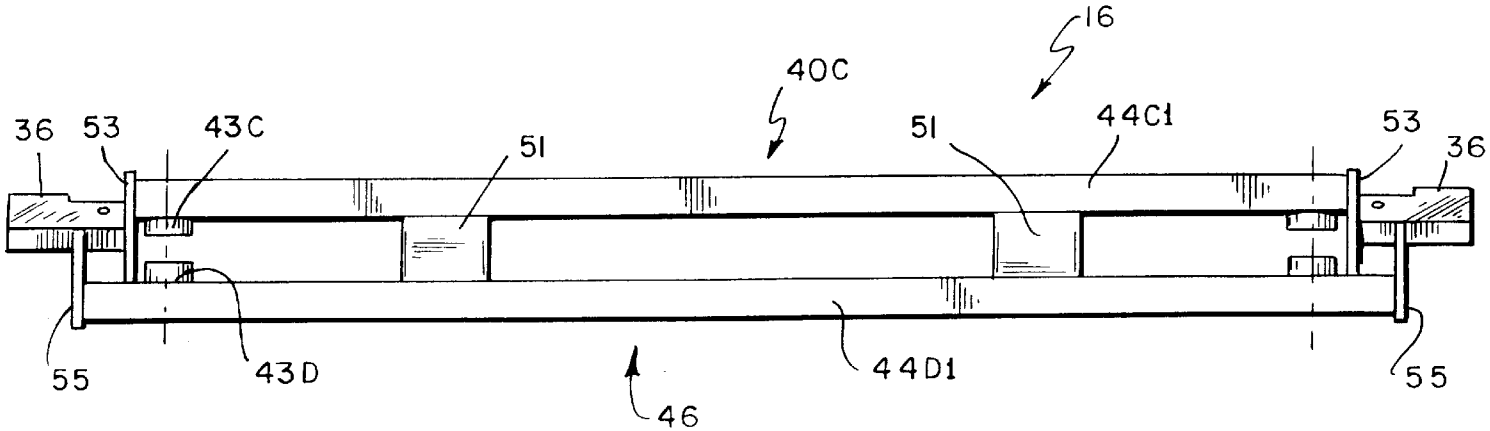
FIG. 10 is a side view of the secondary beam of FIG. 9.

Referring to FIG. 7, the top channeled element 40A of the primary beam 14 has a smaller cross-section at the ends compared to the cross-section at its center. Both the non-wheel side vertical wall 44A1 and the wheel side vertical wall 44A2 are non-parallel and converge at the ends. The bottom channeled element 40B of the primary beam 14 also has a smaller cross section at its ends than it does at the center. Only the non-wheel side vertical wall 44B1 converges towards the unmodified wheel side vertical wall 44B2. Comparing this to the secondary beam 16 illustrated in FIG. 9, only the ends of the wheel side vertical wall 44C2 of the top channeled element 40C converges while the non-wheel side vertical wall 44C1 of the top channeled element 40C and both vertical walls of 44D1, D2 of the bottom channeled element 40D remain parallel to the center section.

The use of channeled stock with its advantage of cost and weight is incorporated in the second embodiment of FIGS. 5–10. The following process is used to create the modified ends of channeled elements 40. The channeled stock 40 is cut to the desired length. The vertical walls 44 are separated from the base 40 starting at the end and terminating at the point at which the modification is to take place. An adjacent portion of the end of the base 40 is removed to create the desired change of cross-section. The vertical wall 44 is then rejoined to the base, by, for example, welding. This completes modification of the cross-section of the ends.

As previously described, this process is used at both ends of the brake side vertical wall 44A2 and 44C2 off the top channeled elements 40A,C of both beams and both of the non-wheeled side vertical walls 44A1 and 44B1 of the top and bottom channeled elements 40A,B of the primary beam 14. After modification of the channeled elements, the weldments 51, join the channeled elements 40 together. The guide feet 36 are then joined by welding to the weldments 53 and 55 which are then joined by welding to the channeled elements 40.

The actuator 20 is supported by the primary brake beam 16 through bell crank levers 70. Opposite ends of the actuator 20 are secured by pins 80 received through aperture 72 in the bell cranks 70. A cotter pin 82 connected through the end of the pin 80. The bell crank 70 is pivotally connected to the center section 40 of the first beam by a pin 84 received in aperture 74 in the bell crank 70 and bores 45 in bases 42. A cotter pin 88 is provided at the end of pin 84 to secure it in place. One end of the push rod assembly 18 is secured to the bell crank 70 by a pin 90 received in aperture 76 of the bell crank 70. A cotter pin 94 holds the pin 90 in place. The other end of the push rod 18 is received and secured to the center section of channeled element 40 of the second beam 16 by pin 96 and cotter pin 98 through bore 45 in base 42.

Figure 5:
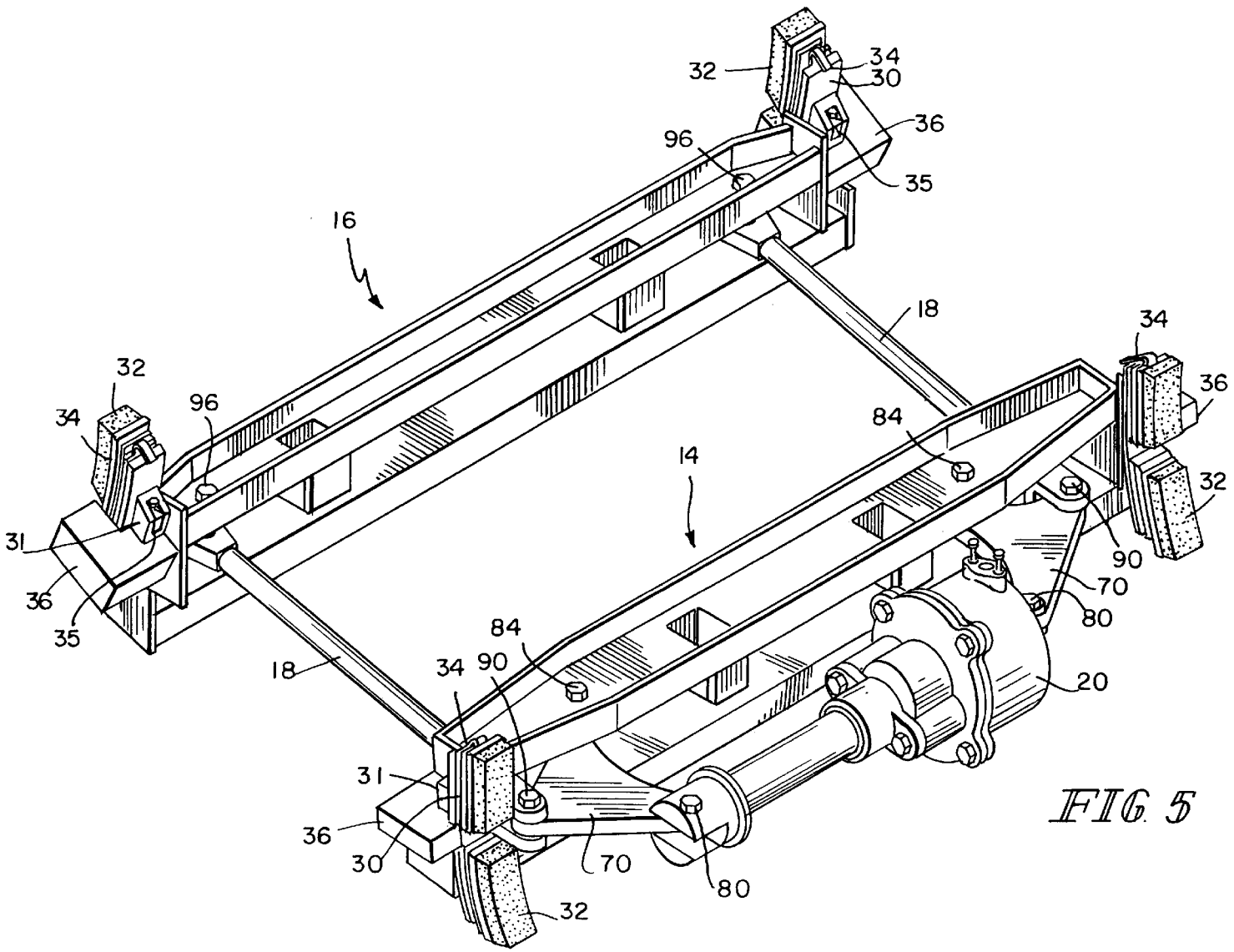
FIG. 5 is a perspective view of another embodiment of a truck mounted brake mounted to the truck incorporating the principles of the present invention.
Figure 6:
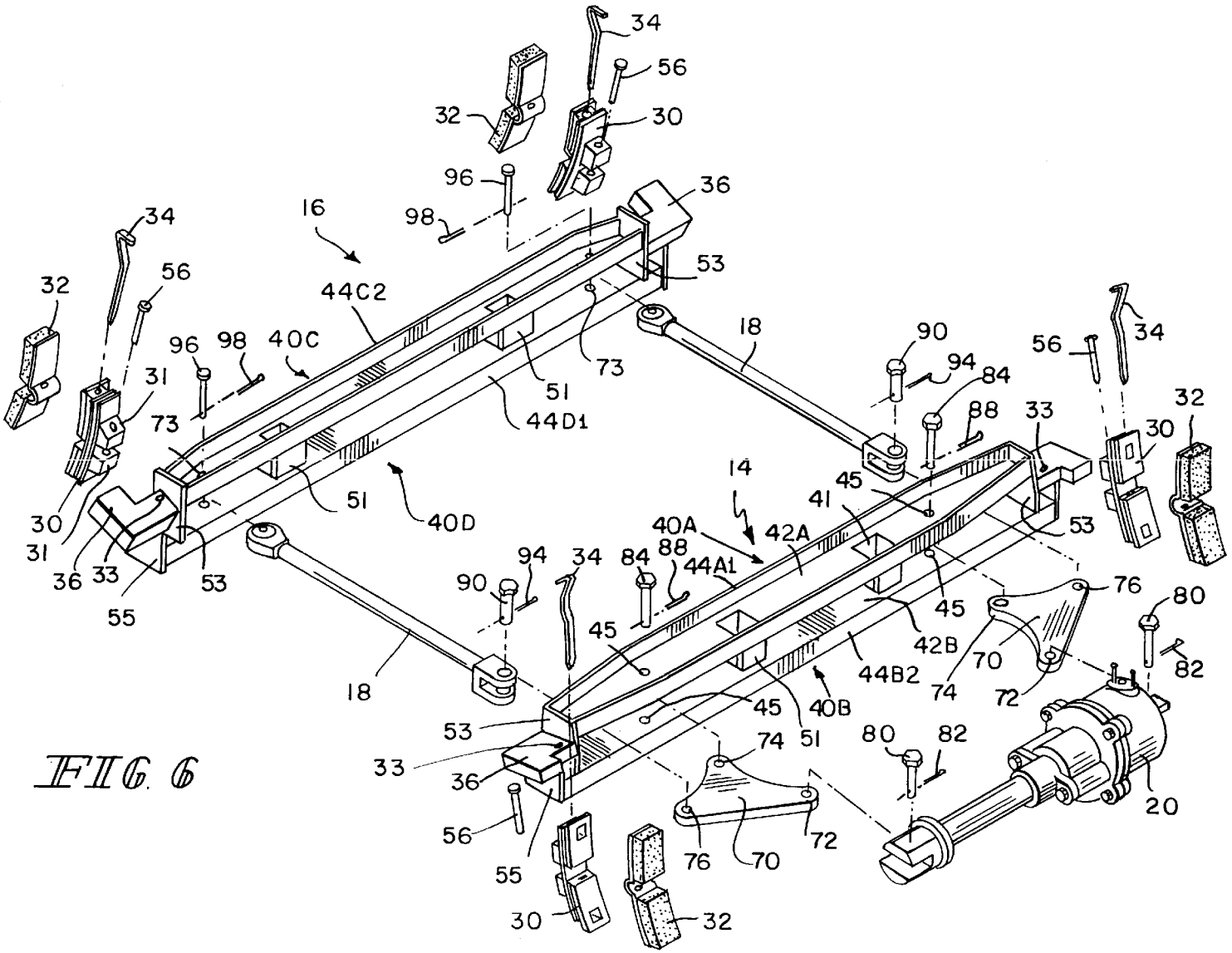
FIG. 6 is an exploded view of the truck mounted brake of FIG. 5.

Bosses 43 are provided on the base 42 and include the bores 45 which receive the fasteners 90 and 96. Bell crank 70 is secured and rides between the bosses 43A and 43B shown in FIG. 8 and the end of the actuating push rod 18 rides is secured to and rides between the bosses 43C and 43D shown in FIG. 10. For sake of clarity, the bosses 43 have been deleted and are shown in FIGS. 5 and 6. All of the bosses 43 act as spacers for the actuator and push rod assembly. The bottom bosses 43B and 44D also act as wear plates since they support the bell crank 70 and the end of the push rod 18 respectfully. The bosses 43 are mounted or secured to the bases 42 by welding. Obviously, this welding takes place prior to the joining of the channeled elements together.

Since the guide feet 36 are unitary with the beam structure, the brake head 30 with the brake shoe 32 are removable from the guide feet 36. The brake head includes a pair of spaced blocks 31 on its back wall between which is received a portion of the guide foot. A pin 56 is extends through aligned apertures 33 in the blocks 31 and the guide foot 36. A tab 35 extending from the top block 31 is bent over the top of the pin 56 to secure it in place. The pin 56 in combination with spacing between the blocks 31 and the guide foot 36 allows for about 3 degrees of movement about a horizontal axis. Since the load is carried by the beam instead of the pin 56, the mounting need not be fixedly secured. Also, the tab 35 being an integral part of the brake head 30 prevents the mounting element from being lost. Almost any pin could be used.

The brake head 30 is restricted from significant lateral movement by the weldment 53 and a transverse wall of the guide foot 36. This would also minimize rotation or swivelling of the brake head 30 laterally.

To replace the brake head, the beams are moved away from the wheel. The tab 35 is straightened and the pin 56 removed. The brake head 30 is then moved towards the wheel until it clears the guide foot 36 and then is moved parallel to the brake beam. The relationship of the brake head 30 and the blocks 31 to the guide foot 36 and the weldment 53 transfers the forces on the brake head 30 to the brake beam and is not primarily dependent upon a pin 56.

It should be noted that since the primary beam 14 carries the actuator and other elements, it is larger than the secondary beam 16. For example, the channeled stock for the primary beam 14 may be 2×6, while the channeled stock for the secondary beam 16 may be 2×4. That is, the vertical walls 44 are 2 inches and the bases 42 are 6 and 4 inches respectfully. These are only examples of dimensions and they may use equal dimensioned stock.

The embodiment of FIGS. 5–10 incorporate the same principles of FIGS. 2–4 which allow the use of stock channel with minor modifications to reduce the weight, costs and the use of an assembly of the present invention.

Although the present system has been described with respect to push rods 18 extending around the bolster 10, the present brake beams, with minor modification, can also be used where the push rods 18 and the actuator 20 extend toward and/or through openings in the bolster. This will cause minor modification of the center section 40 with no modification of the end sections 50 and 60 nor their operation. This would also increase the weight of the center portions 40 to receive the actuator 20 and the push rod assemblies 18 and their interconnected mechanisms. Similarly, although a pair of brake beams are shown, a single brake beam system can also be used using either the primary beam 14 or the secondary beam 16.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A truck mounted rail brake comprising:

at least a primary beam including a center section and at each end an end section having a guide foot to be received in slots in a truck;

a brake actuator connected to the primary beam;

the center section includes two opposed channeled elements joined to each other and each having a base and two walls extending from the base;

the channeled elements being joined by first weldments; and the end sections being joined to the channeled elements by second weldments.

2. A brake according to claim 1, including a brake head removably joined to each end section.

3. A brake according to claim 1, wherein the walls of the opposed channeled elements extend from the base away from each other.

4. A brake according to claim 1, wherein the first weldments are hollow and the bases include openings to the hollow of the first weldments.

5. A brake according to claim 1, wherein a cross-section of the end portions of at least one of the channeled elements are smaller than a cross-section of a center portion of the at least one channeled element.

6. A brake according to claim 1, wherein the actuator is supported by the end sections.

7. A brake according to claim 1, wherein the actuator is supported by the center section.

8. A brake according to claim 7 wherein the bases include a boss at the connection of the actuator to the center section.

9. A brake according to claim 1, including a secondary beam including:

a center section and at each end an end section having a guide foot to be received in slots in a truck; and the center section including at least one channeled element having a base and two walls extending from the base.

10. A brake according to claim 9, wherein the actuator is supported by the end sections of the primary beam and is connected by a force transmitter to the end section of the secondary beam.

11. A brake according to claim 9, wherein the actuator is supported by the center section of the primary beam and is connected by a force transmitter to the center section of the secondary beam.

12. A brake according to claim 9, wherein the center section includes two opposed channeled elements joined to each other and each having a horizontal base and two vertical walls extending from the base.

* * * * *